United States Patent [19]

Goodyer

[11] Patent Number: 4,504,983

[45] Date of Patent: Mar. 19, 1985

[54] TOILET INSTALLATION

[76] Inventor: Anthony W. Goodyer, 73 Chelmsford Rd., Durban, Natal, South Africa, 4001

[21] Appl. No.: 625,561

[22] Filed: Jun. 27, 1984

Related U.S. Application Data

[62] Division of Ser. No. 389,663, Jun. 17, 1982, abandoned.

[30] Foreign Application Priority Data

| | | | |
|---|---|---|---|
| Jun. 22, 1981 | [ZA] | South Africa | 81/4213 |
| Oct. 1, 1981 | [ZA] | South Africa | 81/6796 |
| Jan. 13, 1982 | [ZA] | South Africa | 82/0210 |
| Feb. 16, 1982 | [ZA] | South Africa | 82/0988 |

[51] Int. Cl.[3] ..... E03D 1/00

[52] U.S. Cl. ..... 4/321; 4/460

[58] Field of Search ..... 4/312–315, 4/321, 460, 300

[56] References Cited

U.S. PATENT DOCUMENTS

| | | | |
|---|---|---|---|
| 445,191 | 1/1891 | Niles | 4/321 |
| 1,021,663 | 3/1912 | Cronk | 4/322 |
| 1,200,080 | 10/1916 | Clark | 4/321 |
| 1,203,707 | 11/1916 | Cronk | 4/321 |
| 3,423,766 | 1/1969 | Eger | 4/321 X |
| 3,435,464 | 4/1969 | Hardins | 4/460 |
| 3,842,445 | 10/1974 | Jones | 4/321 X |
| 4,271,539 | 6/1981 | Roberts | 4/321 X |

*Primary Examiner*—Charles E. Phillips

*Attorney, Agent, or Firm*—Browdy and Neimark

[57] ABSTRACT

A toilet has a soil holding tank which does not require connection to external soil disposal facilities. The toilet may be of a fresh water flush type, in which case the soil is contained within a flexible bag inside the tank, and the fresh water surrounds the bag. As the volume of soil in the flexible bag within the holding tank increases, so the volume of flushing water surrounding the bag decreases. Alternatively, the toilet may be of a recirculating type in which case the drum contains a filter through which flushing water is drawn from the tank. When the flushing water is used up and/or the tank is full of soil, the holding tank is sealed and removed from the toilet to be replaced by a recharged holding tank. In another alternative the toilet has no flushing facilities, and when the tank is full of soil, it is sealed, removed from the toilet and replaced by an empty tank.

12 Claims, 14 Drawing Figures

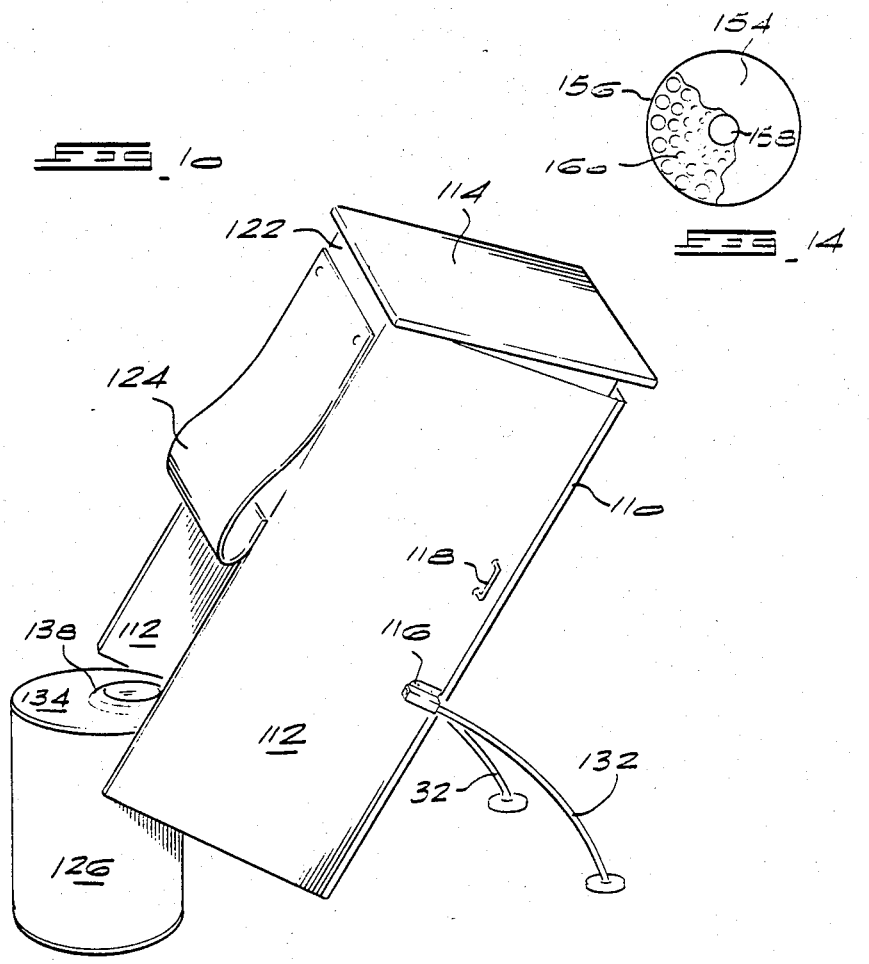
154
156
158
160
10
14
114
122
124
110
118
138
112
116
134
112
132
32
126
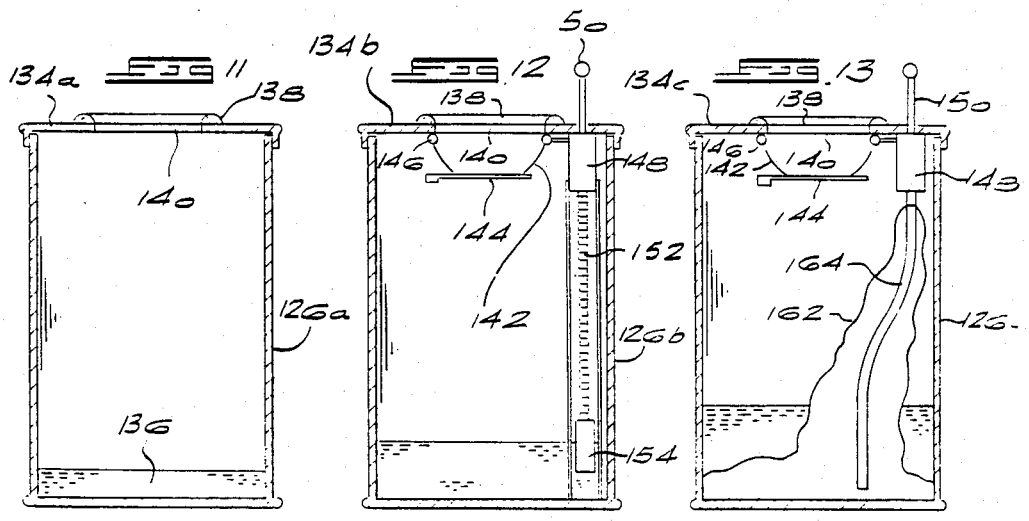
134a
11
138
140
126a
136
134b
12
50
138
146
140
148
144
152
142
126b
154
134c
13
138
50
146
142
140
143
144
164
162
126

TOILET INSTALLATION

This application is a division of applicaton Ser. No. 389,663, filed June 17, 1982, now abandoned.

FIELD OF THE INVENTION

This invention relates to a toilet of the type which is self-contained and does not need to be connected to any external sewage disposal facilities.

SUMMARY OF THE INVENTION

According to the present invention, there is provided a toilet which does not require connection to external soil disposal facilities, the toilet having a housing containing a soil holding tank which is removable from the housing, an opening in a wall of the tank for receiving soil and means for sealing the opening when the tank is full.

It is particularly advantageous if the holding tank is constructed from a cylindrical drum of standard size, such as a 200 l (44 gallon) drum. Such drums are cheap to manufacture because they are already made in large quantities for transporting chemicals and oils, and are particularly easy to handle since equipment for handling these drums is widely available.

The drum may be arranged in the housing with its main cylindrical axis either horizontal or vertical. When the axis is horizontal, the inlet to the drum will be a hole cut in a cylindrical wall of the drum. When the axis is vertical, as is preferred, the inlet will be through one end of the drum, and in this embodiment the drum itself provides the pedestal on which a toilet seat is mounted and supports the weight of a user sitting on the seat.

When the axis is vertical, the upper end wall of the drum may be detachable from the rest of the drum and may carry the flushing mechanism and any toilet bowl which may be provided. When the drum is full, a top end wall with the seat and any other components may be removed and replaced by a closed top wall with which the drum can be transported.

When the holding tank is full of soil, the opening is sealed, and the removable unit can then be taken out and a new unit put in, so that the toilet is immediately available for re-use. The removed unit can then be loaded on a vehicle and returned to a servicing depot where it can be emptied, cleaned, serviced and readied for re-use.

In a first embodiment, the toilet is of the fresh water flush type, and the interior of the holding tank is preferably divided by means of a flexible membrane into a fresh water space and a soil holding space. The toilet housing may support a toilet bowl and the flexible membrane may be in the form of a bag which has a neck connected to the toilet bowl. The bowl then forms part of a unit which includes the holding tank and which can be removed, as a unit, from the housing.

When the holding tank is installed in the toilet, the bag will be compressed and will occupy very little space inside the tank, the majority of the space being taken up by fresh water surrounding the bag. However, as the toilet is used, the volume of the soil inside the flexible bag increases and the volume of the fresh water surrounding the bag is reduced. The use of a flexible bag therefore makes it possible to reduce the overall volume of the tank, since the relative volumes of the fresh water and soil holding spaces alter during use.

In a second embodiment, the toilet is of the recirculating type, and the holding tank preferably includes a filter connected to the suction line of the flushing pump. The toilet bowl may be permanently mounted in the housing.

The filter preferably has no moving parts, in contrast to the socalled "mechanical" filters used on conventional recirculating flush toilets. The filter may for example be a sand filter or a paper filter, with the characteristic that it has an extremely large number of filtering passages, again in contrast to the known "mechanical" filter which has a limited number of filtering passages. The inlet to the filter is preferably through a floating inlet device which draws liquid to be filtered from the surface of the body of liquid in the tank.

In the first embodiment the toilet bowl is preferably of a rubber or rubber-like material which is sufficiently rigid to retain its shape. The diameter of the opening in the cylindrical surface of the drum is slightly less than the diameter of a flange formed integrally with the toilet bowl at the upper edge thereof, so that when the soil holding space is full, the toilet bowl can be lowered on to the drum, and a cover plate can be secured on top of the bowl by clamping means, for example butterfly nuts which screw on to studs fixed around the perimeter of the opening and passing through corresponding holes in a flange of the toilet bowl and through corresponding holes in the cover plate. The drum is then completely sealed and ready to be removed for emptying and cleaning.

Similarly, in the second embodiment, a cover plate or a plug screwed into a threaded socket is secured over the opening when the holding tank is full. In this embodiment there will be no rubber bowl to form a seal between the plate and the surface of the drum, but a suitable sealing ring can be included.

Since with this construction there will be an irregularity on the cylindrical wall of the drum, it is advantageous to provide riding rings around the drum so that the drum can be rolled without damaging the fastenings of the cover plate. For example rubber treads such as are used for motor car tyres can be vulcanized around the circumference of the drum.

The flushing system preferably consists of an annular tube with apertures in it (the flush ring) which fits around the top of the toilet bowl, and a manually operated pump (for the avoidance of doubt, manual operation includes both hand and foot operation). In the first embodiment a dip tube is introduced into the fresh water space through the opening in the cylindrical wall of the holding tank, to the bottom of the tank. Operation of the pump, which is preferably by means of a foot pedal, then draws water from the bottom of the fresh water space through the pump to the flush ring so that the water flushes the sides of the bowl and ends up in the soil holding space inside the bag.

The dip tube is preferably removed from the holding tank when the soil holding space is full, before the tank is sealed with the cover plate.

The fresh water space preferably includes a level sensor which provides a signal when the fresh water is used up, to indicate that the holding tank unit must be changed.

In the second embodiment, the pump has its suction line connected to the tank outlet and its pressure line connected to the flush ring. Operation of the pump then draws water through the filter and to the flush ring.

In a third embodiment, with no flushing facilities, the tank is placed with its opening directly below a toilet seat. During use, the tank fills up and when full, the opening is sealed and the tank removed for cleaning.

The toilet housing, which will normally be in the form of a cabin, may be adapted to tip forward when the drum is to be removed, in order to facilitate drum removal. For this purpose, sockets may be provided intermediate the height of the cabin for legs which will support the cabin in an inclined position and the rear wall of the cabin, at least at the bottom where the drum is located, may be removable, for example in the form of a canvas flap.

BRIEF DESCRIPTION OF THE DRAWINGS

The invention will now be further described, by way of example, with reference to the accompanying drawings, in which:

FIG. 10 shows the toilet cabin tipped forward to give access to the removable drum;

FIGS. 11, 12 and 13 are cross-sections through three alternative forms of drums which can be used in the invention; and FIG. 14 shows part-sectioned a filter for use in one of the drums shown in FIG. 12.

DESCRIPTION OF PREFERRED EMBODIMENTS

Figure 1:
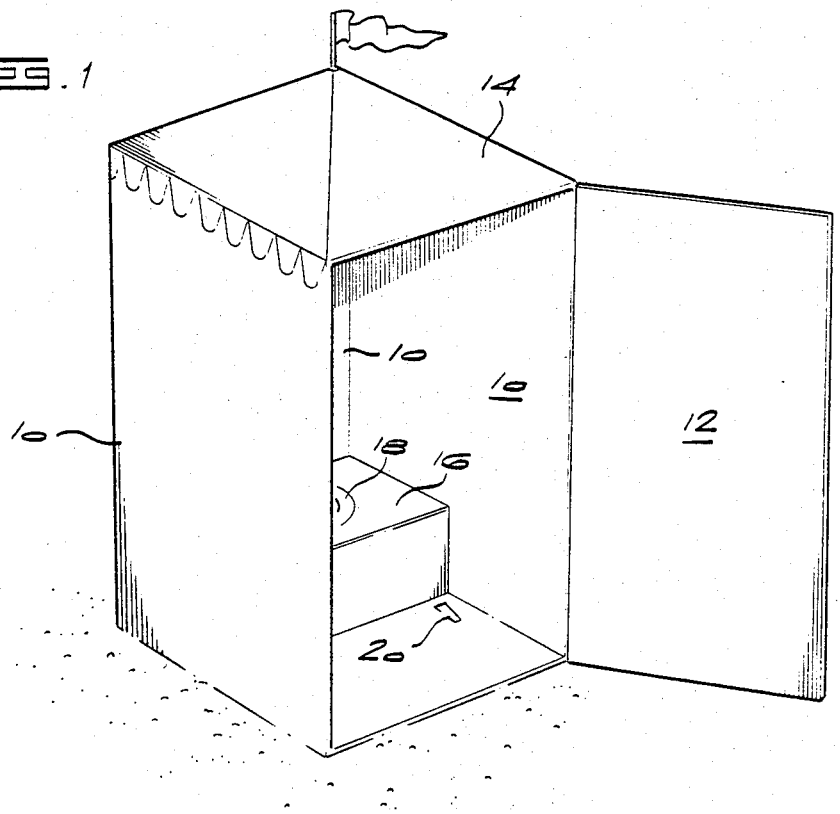
FIG. 1 is a perspective view of a toilet in accordance with the invention, in a cabin, with the door of the cabin open.

The toilet cabin shown in FIG. 1 is free-standing and is not connected to any external services. The cabin consists of three walls 10 and a door 12. Interior door blanks, with their faces suitably cladded, can be used for these components. A canvas roof 14 is provided.

Inside the cabin there is a bench 16 in the middle of which there is an opening fitted with a toilet seat 18. Also visible in FIG. 1 is a foot pedal 20 for operating a flushing pump.

Figure 2:
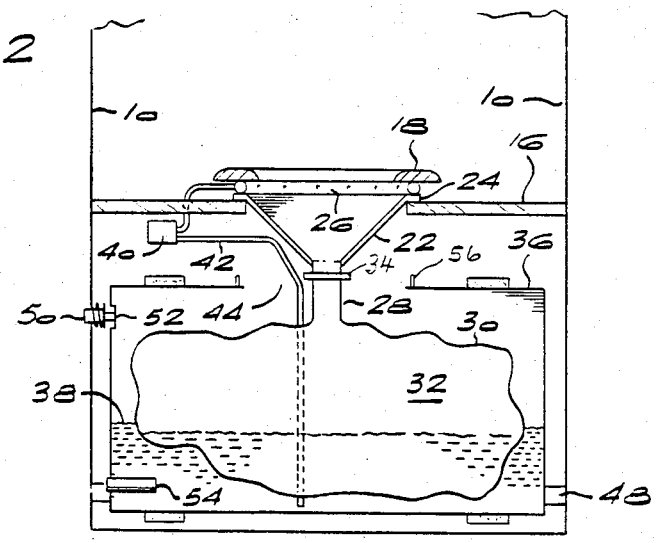
FIG. 2 is a section through a first embodiment of a toilet in accordance with the invention.
Figure 3:
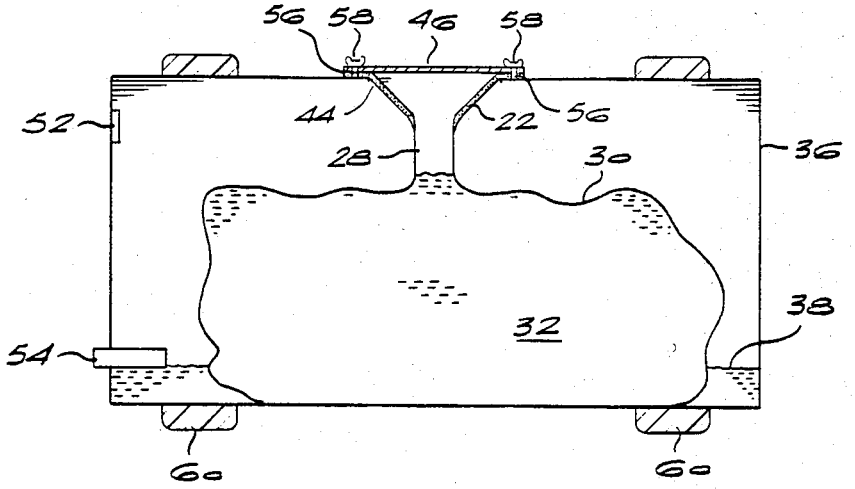
FIG. 3 is a section through the holding tank of FIG. 2, showing the tank full and sealed.

Turning now to FIG. 2, a section through a first embodiment of the toilet is shown. A toilet bowl 22 of a hard rubber material has an external flange 24 which seats on top of an opening in the bench 16. A flush ring 26 surrounds the top of the bowl 22 beneath the seat 18. The bowl 22 communicates via a neck 28 with the interior of a flexible bag 30. The interior of the flexible bag 30 thus forms a soil holding space 32. The connection between the bowl 22 and the bag 30 is permanent.

If desired, a device for closing the neck 28 may be provided. Such a device is indicated schematically at 34, and may consist of some means for throttling the flexible neck 28. For example, this device 34 could be operated by raising of a seat lid (not shown).

The flexible bag 30 is located within a holding tank 36, and the space within the tank 36 surrounding the bag 30 forms a fresh water space. The fresh water level is indicated at 38 in FIG. 2. The fresh water will normally be mixed with a chemical.

The fresh water for flushing is extracted by means of a pump 40 which communicates with the bottom of the tank 36 via a dip tube 42. Operation of the pump 40, by means of the foot pedal 20, causes fresh water to be pumped to the flush ring 26. In FIG. 2, the pump 40 is only shown schematically, for clarity of illustration.

Figure 7:
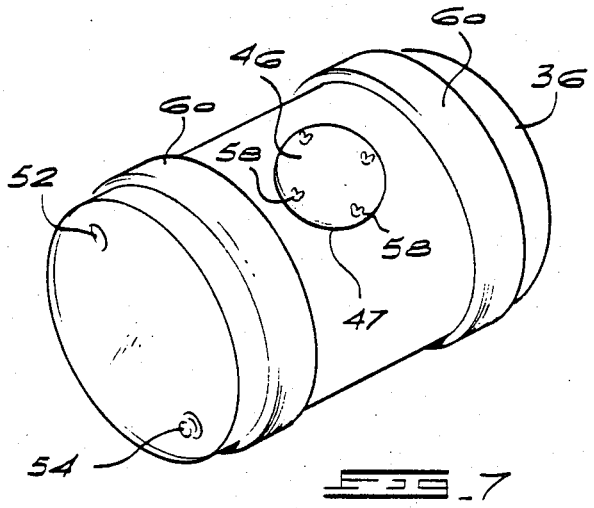
FIG. 7 is a perspective view of a sealed holding tank.

The neck 28 of the bag 30 and the dip tube 42 pass through an opening 44 in a cylindrical wall of the tank 36. As can be seen in FIG. 7, the tank 36 is a cylindrical drum. In FIG. 7 the opening 44 can be covered by a cover plate 46.

The tank 36 is supported on two bars 48 at the bottom of the cabin, below the bench 16. In FIG. 2 only one of these bars can be seen, but it will be appreciated that the two bars will be arranged parallel to one another so that the tank 36 can sit on them. Rollers (not shown) may be mounted on the bars to enable the tank 36 to be rotated on the bars until the opening 44 is uppermost. To ensure that this position can be maintained, a spring-loaded plunger 50 mounted in one of the walls 10 engages in the conventional vent plug 52 usually found in clyindrical drums of this type. Furthermore, a water level sensor 54 is mounted in the tank in the hole conventionally provided for discharge of the contents of such a cylindrical drum.

As previously mentioned, it is most convenient if the tank 36 is a cylindrical drum of standard size, e.g. a 200 l (44 gallon) drum. The sensor 54 will be connected to suitable indicating equipment to provide a visual or audible signal that the fresh water in the tank 36 has been used up.

When this signal is noticed, the tank must be sealed and removed. The first step in doing this is to withdraw the dip tube 42 through the opening 44. The seat 18 is then raised and the flush ring 26 released. The bowl 22 is then deformed to allow it to pass through the opening in the bench 16, and it is then lowered into the tank 36 on top of studs 56 surrounding the opening 44. A cover plate 46 then fits over the bowl 22, with the edge of the bowl forming a seal 47, and is secured in place by butterfly nuts 58 (FIG. 7). The tank contents are then sealed in place, and the tank can be removed by rolling it out of the cabin (the bottom half of the back wall 10 can be formed by a canvas flap to give easy access to the tank), and can be removed for emptying and cleaning.

At the same time, an emptied, cleaned and re-filled tank is put into place by locating it on the bars 48 with its opening 44 uppermost, removing the plate 46, raising the bowl 22 through the bench and replacing the dip tube, flush ring and seat.

To facilitate handling, the circumference of the drum is provided with rubber riding treads 60 on which the drum can roll without the nuts 58 fouling the surface on which the drum is rolling. These treads 60 can be conventional treads used for motor car tyres, vulcanised on to the drum.

Figure 4:
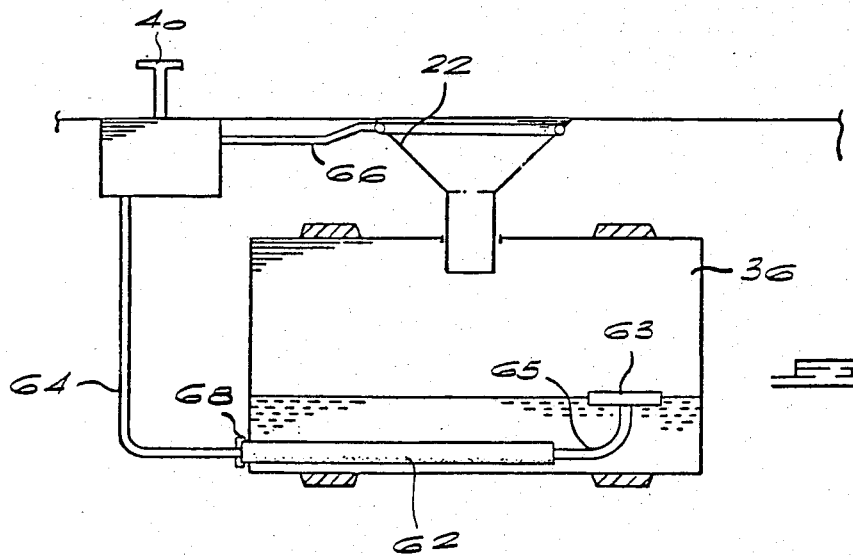
FIG. 4 is a section through a second embodiment of a toilet in accordance with the invention.
Figure 5:
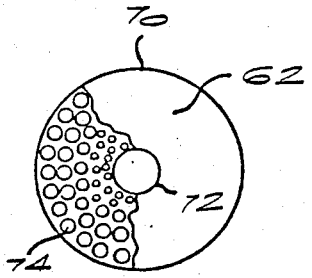
FIG. 5 is a cross section through the filter shown in FIG. 4.

FIGS. 4 and 5 show details of a second embodiment, which is a "recirculating" flush type toilet. In these figures, corresponding parts will bear the same reference numerals as in the preceding figures.

The holding tank 36 receives soil through the bowl 22 and has a filter unit 62 at the bottom. Liquid is drawn from the water surface through a floating inlet device 63, through a flexible hose 65, through the filter 62 and through a pipe 64 by the pump 40. The filtered liquid is then pumped along a pipe 66 into a flush ring 26 around the bowl 22. The use of a floating inlet device prevents the filter becoming choked with sediment collecting at the bottom of the tank, and ensures that the liquid passes through the whole length of the filter.

Before use, the holding tank 36 is charged with a small quantity of fresh water and with the necessary chemicals. The thus charged holding tank is then transported to the toilet site and brought into position in the cabin below the bowl 22. The toilet is then ready for use. After each use the toilet is flushed by operating the pump 40 which causes chemically treated and filtered water to be drawn from the bottom of the tank 36 through the pump 40 and into the bowl 22.

When the tank 36 is full, a cover plate 46 is bolted over the hole which communicates with the bowl, and a releasable connection 68 between the pipe 64 and the filter 62 is undone and replaced by a closed cap. The full tank 36 can then be removed from the cabin and replaced by a recharged tank. The full tank is removed to a depot where its contents are emptied into a sewer and where the filter 62 is backwashed or its element removed and replaced.

The tank can then be recharged and made ready for reuse.

The filter 62 will inevitably tend to clog in use, and must be cleaned before the tank can be put back into use. Since the tank can be removed to a service depot, thorough cleaning of the filter, by backwashing or other methods, is possible. Such thorough cleaning is not possible if the tank is fixed, and it is thus only with the removable tank of the present invention that the highly efficient type of filter described can be used.

FIG. 5 shows a section through the filter 62. The filter has an outer perforated tube 70 and an inner perforated tube 72. The space between these tubes is packed with sand grains 74, and the grains are graded with the larger grains being nearer the outer tube 70. A filter of this type can conveniently be manufactured by glueing the grains on to the inner tube 72 using a water soluble glue. When the full cylindrical shape has been completed, the outer tube 70 is slid over the grains, and the filter is then ready for use. The water soluble glue will be washed out in the first few uses of the filter. However, instead of a sand filter, a paper filter or indeed many other different types of filter may be used. The filter preferably extends the whole length of the drum 36, as shown in FIG. 4, to allow the maximum number of filtering passages to be exposed and to reduce any likelihood of the filter becoming clogged.

Figure 6:
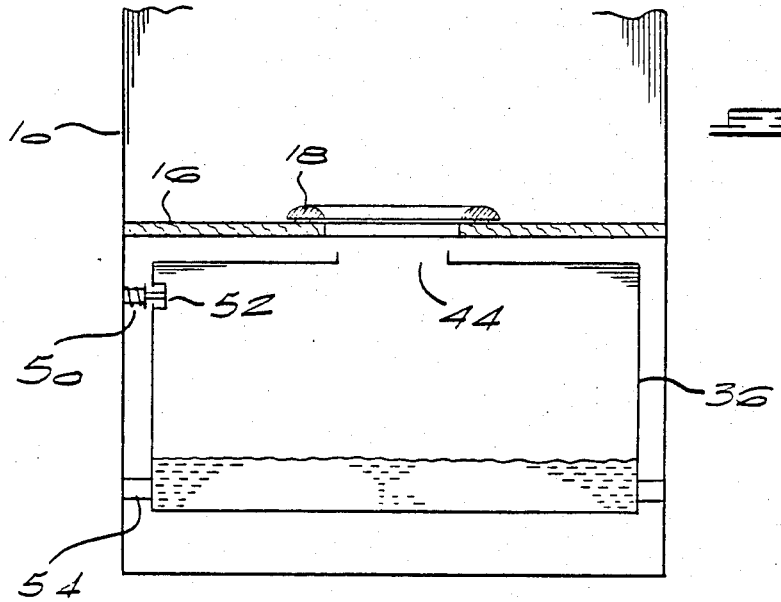
FIG. 6 is a section through a third embodiment of a toilet in accordance with the invention.

The embodiment shown in FIG. 6 uses the same reference numerals as the earlier figures, for corresponding parts. In this embodiment there are no flushing facilities, and the drum 36 remains in position until it is full, whereupon it is sealed by means of a plate 46, as shown in FIG. 7. A seal ring 47 is placed between the plate 46 and the outer surface of the drum 36.

Figure 8:
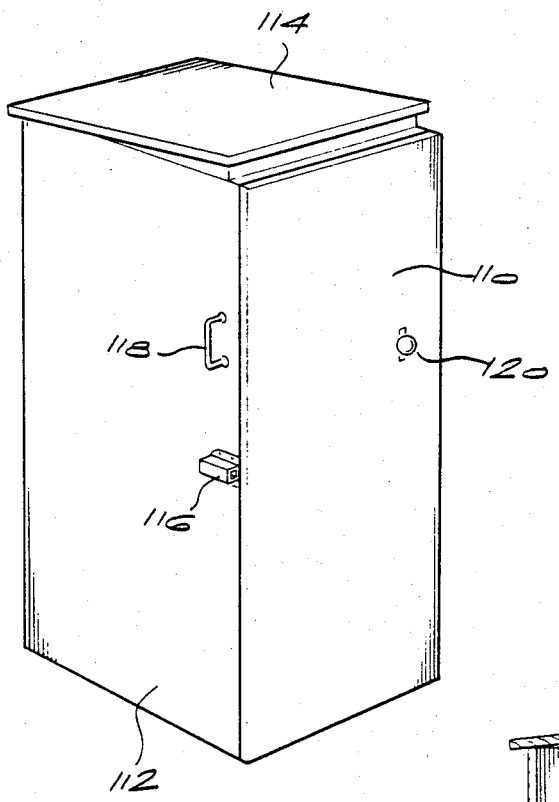
FIG. 8 is a perspective view of a toilet in accordance with the invention.

FIG. 8 shows a toilet cabin with a door 110, side walls 112 and a roof 114. On each of the side walls 112, sockets 116 and handles 118 are provided for purposes which will be described later. The door 110 has a handle 120.

Figure 9:
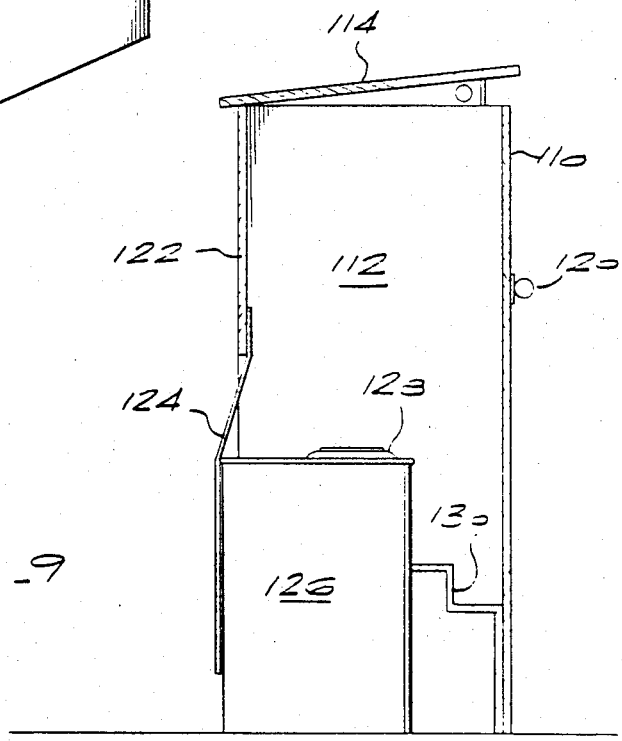
FIG. 9 is a section through the toilet cabin in FIG. 1.

The interior of the cabin can be seen from FIG. 9. The back wall 122 stops at about half height and is continued by a canvas flap 124. Within the cabin there is a drum 126 which sits on the ground and has a toilet seat 128 mounted around a hole in its upper surface. Steps 130 enable a user to mount to the level of the top of the tank 126 and to sit on the seat 128.

When the tank 126 is full, and has to be removed and replaced by an empty tank, an operator first places two legs 132 in the sockets 116 on the side walls 112 of the cabin. He then grasps the handles 118 and pulls the cabin forward about the bottom of the door 110. The length of the legs 132 is chosen such that the cabin will then rest securely in the tipped position shown in FIG. 10. The canvas flap 124 is then hooked up as shown to the top of the back wall 122 so that the tank 126 is revealed.

An exchange of drums 126 can now take place. The operator brings with him a fresh tank which has been emptied, cleaned and charged with chemical. He removes a closed lid from the fresh tank and the lid 134 from the full tank. The lid 134, together with any components which may be suspended from it, is then attached to the fresh tank, and the closed lid from the fresh tank is attached to the full tank. The full tank which is now completely closed and sealed can then be loaded on a vehicle, whilst the fresh tank with its lid 134 in place can be put into the position vacated by the full tank 126, and the cabin can be lowered into its normal position. Struts 132 are then removed, and the operator can take the full tank away to a service depot for emptying, cleaning and recharging.

The drum **126*a* shown in FIG. 11 has a lid 134*a*. The lid and drum would be detachable from one another and there will be some sort of connecting means by which the two can be firmly connected and sealed to one another. The drum 126*a* has no internal components. When this drum is ready for use, it will be charged with a small quantity of chemical 136. The lid 134*a* has a seat 138 surrounding an opening 140, and the soil simply passes through the opening 140** and collects in the drum.

The drum **126*b* shown in FIG. 12 is of a recirculating flush type. A bowl 142 is mounted below the opening 140 in the lid 143*b*, and a bowl seal plate 144 is provided below the bowl. A flush ring 146 is also provided at the top of the bowl. A pump 148 has an operating handle 150 and draws water through a flexible, compressible tube 152 from a floating filter unit 154. The filter unit 154 floats on the surface of the matter in the drum, and is in the form of a sand filter or another type of filter which has a very large number of filtering passages (for example as shown in FIG. 14). As the level in the drum rises, the filter unit 154 rises and the tube 152 compresses. Since the filter unit 154 floats, it will always draw from the lost liquid portion of the material in the drum which needs less filtering than the more solid material at the bottom of the drum. The filtered liquid is pumped through the pump body 148 and out through the flush ring 146 into the bowl 142. When the lid 134*b* is removed a snap connection below the pump 148 and between the pump and the filter unit is released so that the filter unit stays in the drum whilst the pump 148 is withdrawn with the lid 134*b***.

The drum **126*c* shown in FIG. 13 has a fresh water flush type of arrangement. The interior space of the drum is divided by a flexible bag 162 into a fresh water space within the bag and a soil holding space outside the bag. When the tank is ready for use, the bag will be full of fresh water, and there will be very little space within the drum outside the bag. However, as the toilet is used, fresh water will be drawn from within the bag 162 to flush the bowl 142, and will then pass into the space outside the bag 162 which will gradually increase in volume. The pump 148 has a dip tube 164 which extends to the bottom of the bag 162**.

In place of the arrangement shown, the fresh water may be stored outside the bag 162, and the soil inside the bag.

In any of the different embodiments shown, a sensor may be provided to indicate when the drum needs to be replaced.

When the lid 134*c* is removed, a snap connection will be released at the point where the dip tube 164 passes through the wall of the bag 162, so that the pump is removed with the lid whilst the bag remains in the tank.

The arrangments shown in FIGS. 11, 12 and 13 made it possible to alter a toilet type, e.g. from flushing to non-flushing whenever the toilet is serviced.

I claim:

1. A toilet which does not require connection to external soil disposal facilities, comprising:

a housing, a soil holding drum removable from the housing and provided with separate compartments for soil and fresh water, with said separate compartments being divided by means of a flexible membrane into a fresh water space and a soil holding space, an opening in a wall of said drum for receiving soil, a toilet bowl supported by said housing, said flexible membrane being in the form of a bag which has a neck integral with said toilet bowl, said bowl being removable from the housing together with said drum, and means for sealing the opening when the drum is full.

2. A toilet according to claim 1 in which the opening is formed in a cylindrical wall of the drum.

3. A toilet according to claim 1 including a flushing pump for drawing flushing water from the drum, passing it through the bowl and back to the tank.

4. A toilet according to claim 3 including a flushing circuit which is part of the housing and is not removable with the drum, the flushing circuit comprising a dip tube to be introduced into a fresh water space in the drum, a manually operated pump, and a flush ring surrounding the top of the toilet bowl.

5. A toilet according to claim 1 in which the bowl is of a shape retaining material and the diameter of the opening in the soil holding tank is slightly less than the diameter of a flange formed integrally with the toilet bowl at the upper edge thereof, and the sealing means includes clamping means provided around the opening, and a cover plate, so that the bowl flange can be clamped to the edge of the opening between the cover plate and the drum, thereby to seal the fresh water space and the soil holding space.

6. A toilet according to claim 1 in which the drum includes a filter and an outlet, the filter communicating with the outlet and the outlet communicating with a flushing pump so that operation of the pump causes water to be drawn from the drum, through the filter to the outlet and from there through the pump to the toilet bowl.

7. A toilet according to claim 6 in which the filter has no moving parts.

8. A toilet according to claim 7 in which the filter is a sand filter which extends substantially the full length of the drum.

9. A toilet according to claim 6 in which the filter has a floating inlet device connected to the filter inlet and adapted to draw liquid for the filter from the liquid surface in the tank.

10. A toilet according to claim 1 in which the drum is a 200 l (44 gallon) drum provided with circumferential riding rings.

11. A toilet according to claim 10 in which the riding rings are rubber tyre treads.

12. A toilet according to claim 1 in which the sealing means comprises a seal ring to surround the opening, a cover plate to cover the opening and clamping means for clamping the cover and the seal ring in place on the drum.

* * * * *